US005579797A

United States Patent [19]

Rogers

[11] Patent Number: 5,579,797

[45] Date of Patent: Dec. 3, 1996

[54] FOLDABLE CANOPY SUPPORT

[76] Inventor: Allen E. Rogers, 2442 N. Cedar, Owatonna, Minn. 55060

[21] Appl. No.: 529,809

[22] Filed: Sep. 18, 1995

[51] Int. Cl.[6] ..... E04H 15/04; E04H 15/48

[52] U.S. Cl. ..... 135/90; 135/96; 135/88.01; 135/903; 135/99

[58] Field of Search ..... 135/87, 88.01, 135/88.03, 88.13, 88.11, 88.12, 90, 96, 97, 99, 123, 143, 147, 155, 117, 903; 248/231.71, 539

[56] References Cited

U.S. PATENT DOCUMENTS

| | | | |
|---|---|---|---|
| 554,792 | 2/1896 | Pittenger et al. | 135/88.01 |
| 614,364 | 11/1898 | Burnham | 135/90 X |
| 882,870 | 3/1908 | Cary | 135/90 X |
| 1,018,522 | 2/1912 | Savage | 135/99 X |
| 2,618,285 | 2/1949 | Heisig | 135/88.01 |
| 2,821,204 | 1/1958 | Hartshurn, Sr. | 135/88.01 |
| 2,859,756 | 11/1958 | Barnes | 135/903 X |
| 2,984,249 | 5/1961 | Sears et al. | 135/90 X |
| 3,032,045 | 5/1962 | Francis | 135/90 |
| 3,032,046 | 5/1962 | Coonradt | 135/90 |
| 3,943,524 | 3/1976 | Sample | 248/539 X |
| 4,068,673 | 1/1978 | Bernardi | 135/90 X |
| 4,502,786 | 1/1986 | Pruonto | 135/88.01 X |
| 4,683,900 | 8/1987 | Carmichael | 135/88 |
| 4,781,411 | 11/1988 | Kolb | 248/289.1 |
| 4,836,232 | 6/1989 | De Rosa et al. | 135/147 X |
| 4,865,381 | 9/1989 | Van Rogue | 135/96 X |
| 5,000,210 | 3/1991 | Worthington, Jr. | 135/90 |
| 5,009,184 | 4/1991 | Voldrich | 135/88.01 |
| 5,016,558 | 5/1991 | Oehler | 135/88.01 |
| 5,096,257 | 3/1992 | Clark | 135/96 X |
| 5,441,067 | 8/1995 | James et al. | 135/96 |

*Primary Examiner*—Wynn E. Wood

[57] ABSTRACT

A foldable, adjustable-height, canopy support which can support up to four independent rectangular canopy-segments. The segments are cantilevered from a single mast. All support elements remain interconnected and fold parallel for storing and ease of portage. The support may include integral canopy-segments which retract onto elongated rollers when not in use. A demountable foot having clamps for attaching the bottom end of the mast to a solid object is also disclosed.

15 Claims, 4 Drawing Sheets

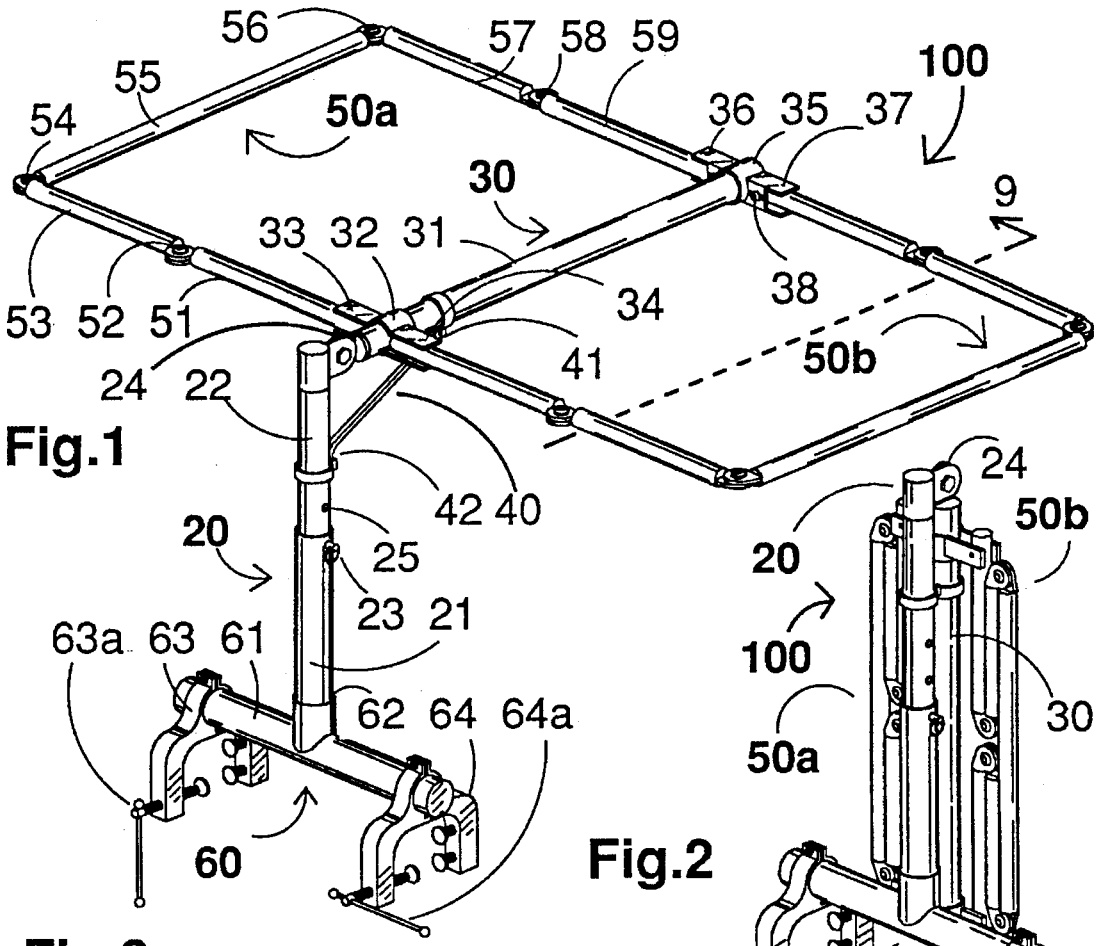
Fig.1
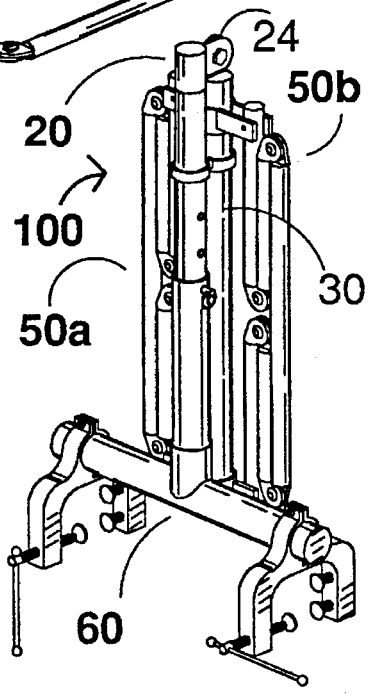
Fig.2
Fig.3
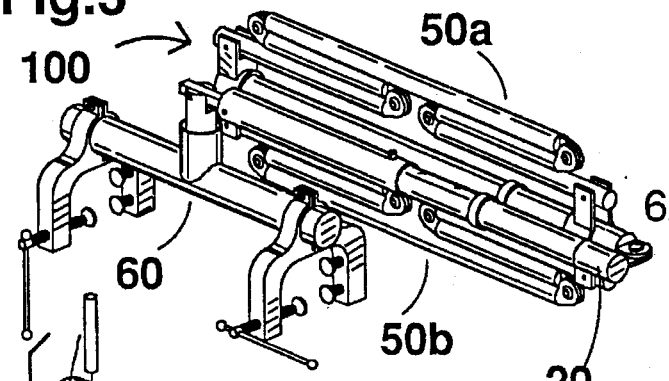
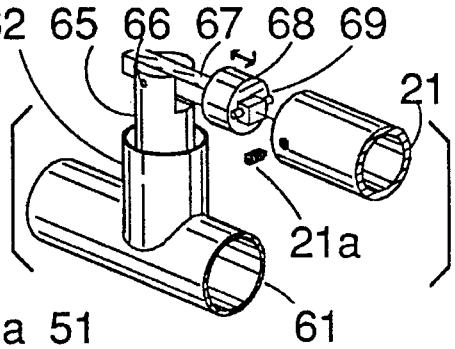
Fig. 4
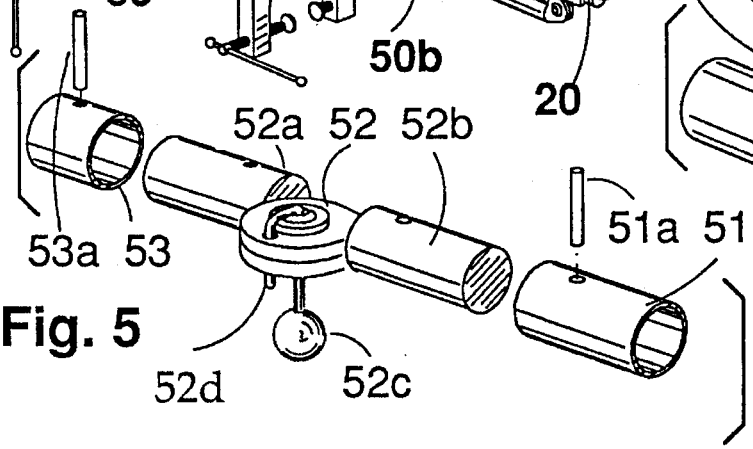
Fig. 5

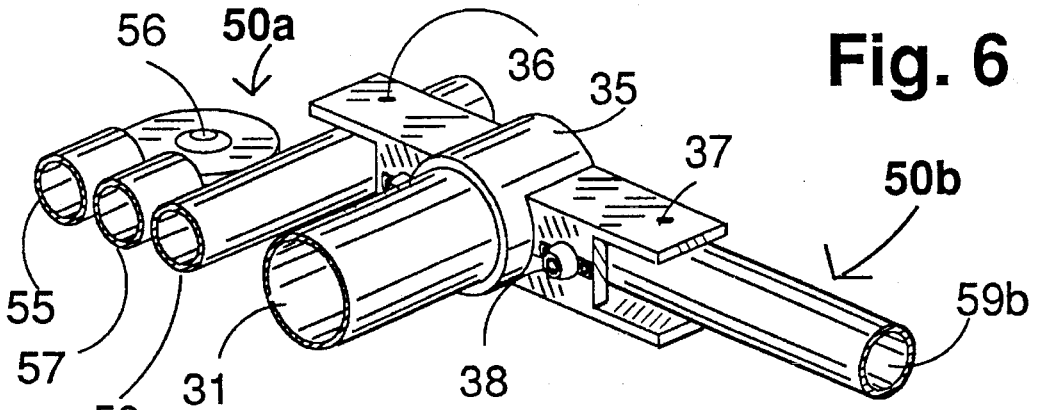
Fig. 6
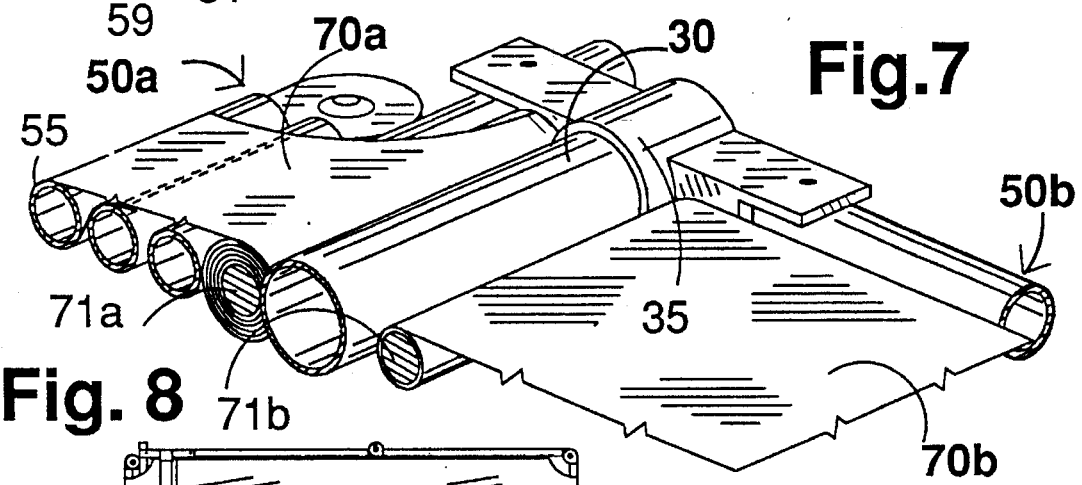
Fig.7
Fig. 8
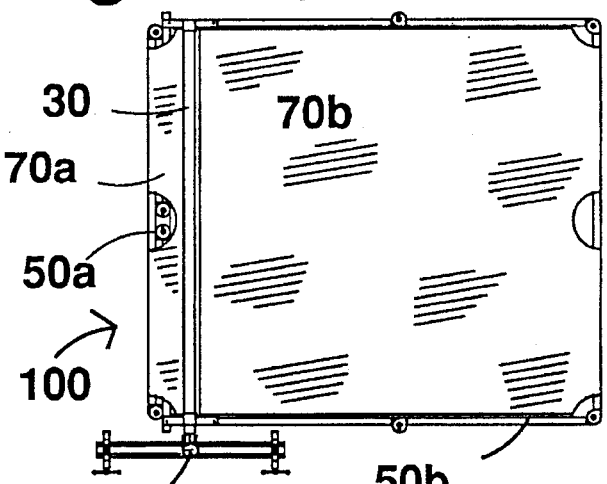
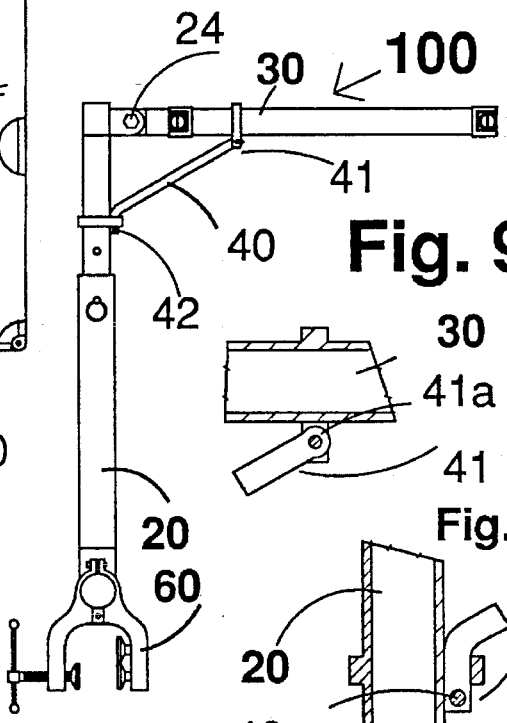
Fig. 9
Fig. 9a
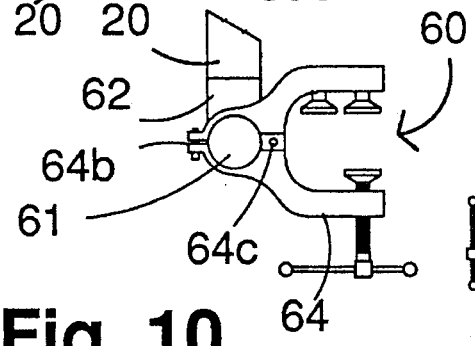
Fig. 10
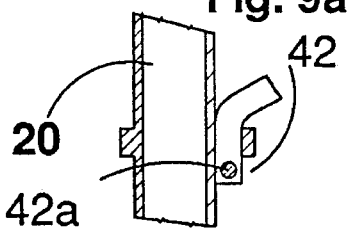
Fig. 9b 154a
150a
156a
155a
136
159a
151a
132
171a
135
133
172a
173a
133a
131
170a
130
131
138
171b
172b
139
135b
173b
170b
173b
137
134
151b
159b
135
155a
130
135a
170b
132
170a
159b
156a
171b
135b
11
133a
133c
133b
151b
A
125
130
155b
141
126

120
140
130
170b
142
155b
90
160
161
170a
166a
166b
164a
120

FOLDABLE CANOPY SUPPORT

BACKGROUND

1. Field of Invention

This invention relates to portable foldable canopy supports.

2. Prior Art

Numerous forms of structure for supporting canopies which provide shelter from the natural elements such as sunlight or rain have been invented. The most well known type of canopy structure is that of the umbrella or parasol. However, the centrally supported foldable rib and cloth structure of the familiar parasol or umbrella does not suit all shelter environments. The circular canopy does not effectively shelter rectangular areas, the mushroom shape is vulnerable to gusts of wind and it is often impractical to provide a support connection at the center of the area to be sheltered.

Others have invented canopy structures which avoid some of the disadvantages of the umbrella or parasol. U.S. Pat. No. 4,865,381 to Van Rogue discloses "A Sunshade Attachment" for a chair constructed from an assembly of U-shaped members. The sunshade covers a rectangular area and fastens to the back of a chair, attached via one of the U-shaped members. U.S. Pat. No. 4,781,411 to Kolb discloses a "Portable Sun Shield" made from plastic piping. This shield is substantially rectangular, and is cantilever-supported at the center of one of the sides of the rectangle by means of a vertical mast. The supporting structure can be separated into two major segments to make it more portable. U.S. Pat. No. 2,821,204 to Hartshorn, Sr. discloses a rectangular rib and cloth style canopy demountably attached to a boat. The supporting ribs are centrally held under the canopy by a tubular bar which projects as a cantilevered member from a vertical mast positioned outside the perimeter of the canopy. These disclosures argue the need for the rectangular shape, and provide canopy designs which are portable and more adaptable to wind conditions than an umbrella. They have a means for supporting the canopy above a solid base object which is not disposed directly under the area of the canopy.

Prior art does not satisfy the need for a structure that can selectively shelter rectangular areas at an adjustable height. The above patent disclosures do not describe a compactly foldable canopy support which holds all the members parallel and interconnected in the folded state. The above disclosures do not show how to make a canopy support that can have up to four independently foldable rectangular canopy segments integral with the canopy support.

SUMMARY OF THE INVENTION

This disclosure describes a substantially rectangular canopy support frame extending in a generally perpendicular plane from a single mast. In its simplest form the rectangular frame is a single inverted U-shaped frame assembly attached to a spar. The spar pivotally connects to the mast and extends perpendicularly from the mast. The end of each leg of the "U" is firmly attached to the spar, one leg is attached to an "inner" point near the mast and the other leg is attached to an "outer" point furthest from the mast. The spar pivotally connects and is held perpendicular to the mast by a brace. The brace provides a triangulated structural element between the mast and the spar. The brace can be in tension, downwardly angled from the mast to the spar, or in compression, upwardly angled from the mast to the spar. The height of the supporting frame above the bottom of the mast can be adjustable.

The mast can be fastened at its bottom end to a solid object capable of supporting the structure over the area to be sheltered, or it may be connected to the solid object by means of a foot. The foot may include adjustable clamps and means for adjusting the angle of the mast with respect to the solid object. Examples of solid objects include a table-top, a chair back, the deck of a boat, the rail of a deck.

The U-shaped frame assembly is made from a number of frame elements which can fold compactly against the spar such that all the members are held in parallel with each other. With the brace disconnected at one or both ends, the spar will fold against the mast in a collapsed mode. Even the foot, if used, may be connected to the mast bottom by a hinge so that the structure can be folded and laid down parallel with it. To portage the structure, all the major elements lie parallel with each other and are held in a connected form.

To increase the shelter capability of the structure each spar is made to support two oppositely extending U-frame assemblies. The canopy area can be further increased by attaching two oppositely extending spars to the mast with each spar supporting two oppositely extending U-frame assemblies.

The canopy supported by the mast may be a separate item made from canopy material, or it may be integral with the structure. A preferred canopy is wound onto a long cylindrical roller which is rotatably attached in parallel with the spar. The area of canopy useful for shelter is that which is held between the cylinder and the end member of the U-shaped frame assembly furthest extended from the spar. When the frame assembly is folded against the spar the canopy is wound compactly onto the roller. A retracting mechanism for winding the canopy onto the cylinder is provided. The mechanism may be manually operated by means of a handle or knob, or automatically operated by means of a torsion spring inside the roller in a manner well known to be used for retracting window shades. When the canopy support has more than one frame assembly each one may include an automatically retractable integral segment of the total canopy.

BRIEF DESCRIPTION OF THE DRAWINGS

FIG. 1—Isometric of an extended canopy support.

FIG. 2—Isometric of collapsed spar and folded frames.

FIG. 3—Isometric of a folded canopy support.

FIG. 4—Isometric of a mast to foot hinge connection.

FIG. 5—Isometric of a typical U-flame bifold lock.

FIG. 6—Isometric section of a U-frame-to-spar hinge.

FIG. 7—Isometric section of a U-frame and canopy-segments.

FIG. 8—Top view of the first embodiment.

FIG. 9—Side elevation of the first embodiment.

FIG. **9*a***—Detail of a fulcrum point.

FIG. **9*b***—Detail of a support point.

FIG. 10—Side elevation of a foot clamp.

Figures 11, 12, 13:
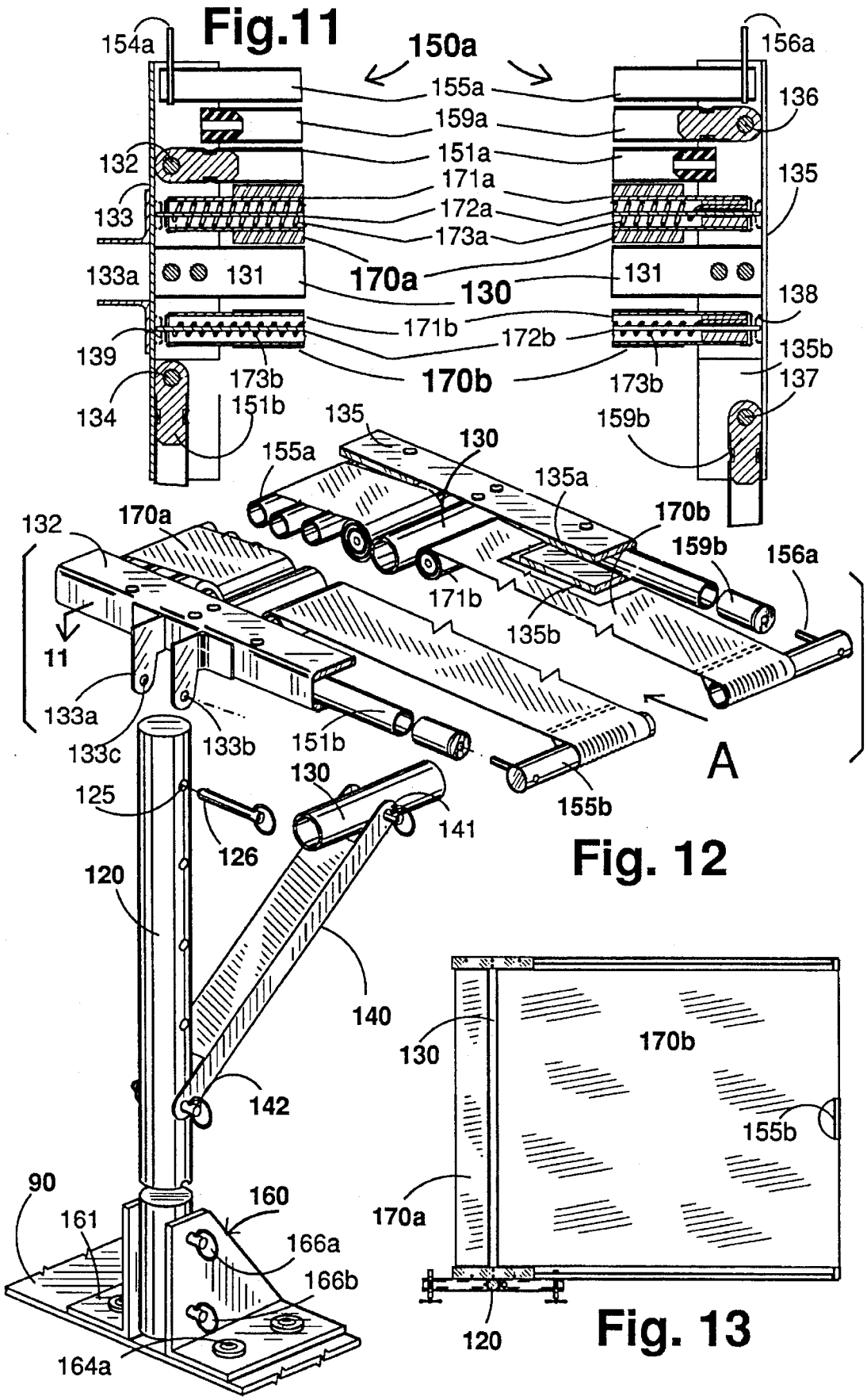

FIG. 11—Section through second embodiment frame.

FIG. 12—Isometric of the second embodiment.

FIG. 13—Top view of the second embodiment.

Figure 14:
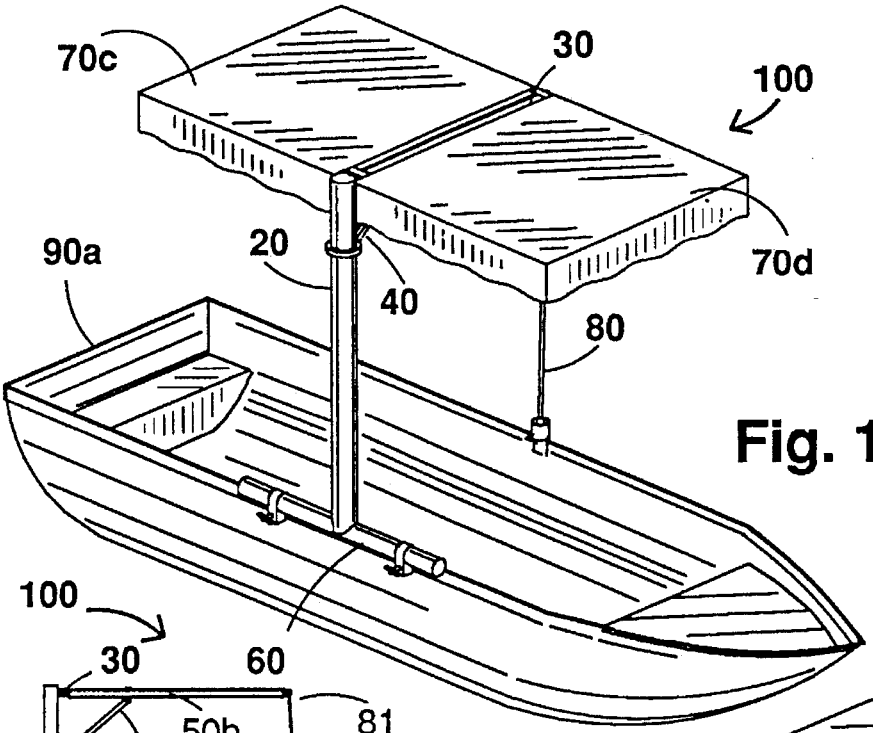

FIG. 14—Perspective of a boat canopy.

Figure 15:
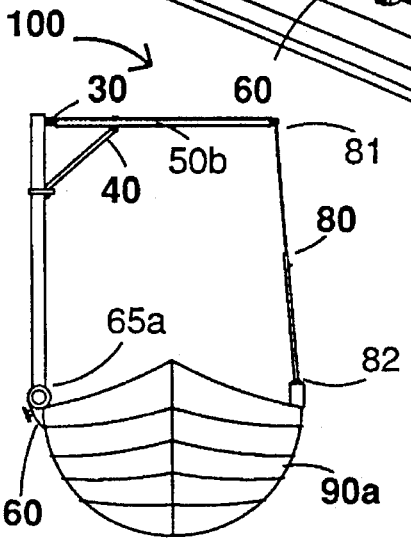

FIG. 15—Front elevation of a boat canopy support.

Figure 16:
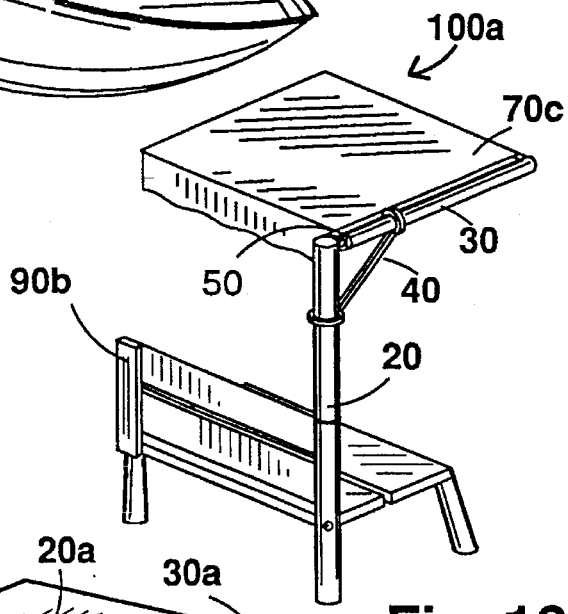

FIG. 16—Perspective of a bench canopy.

Figure 17:
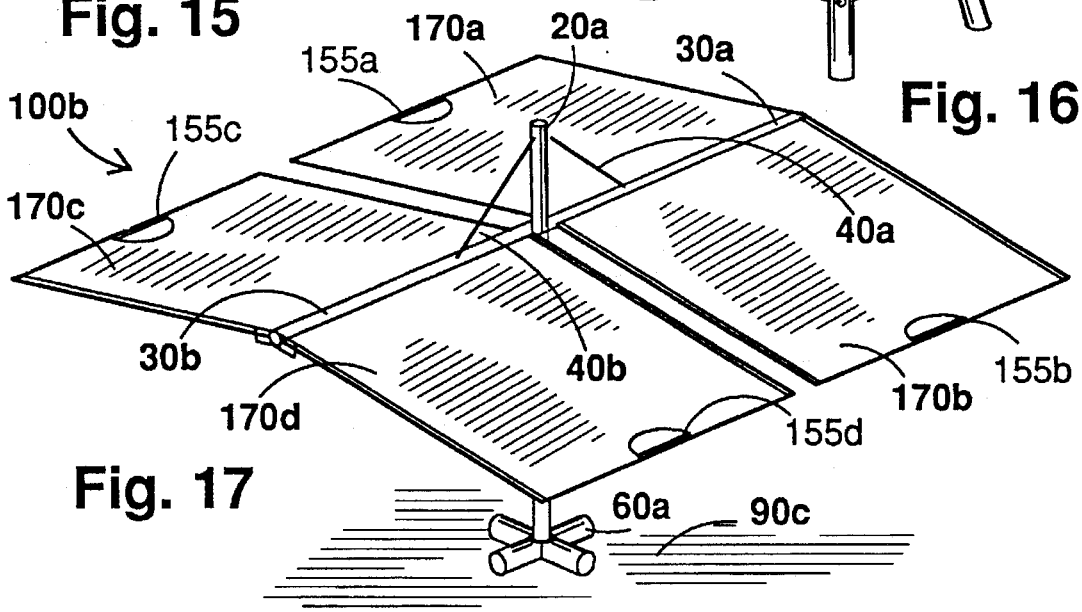

FIG. 17—Perspective of a four segment canopy.

DETAILED DESCRIPTION

FIG. 1 is an isometric view of preferred canopy support 100 mounted on foot 60. Canopy support 100 has two frame assemblies 50*a* and 50*b* attached to spar assembly 30. These assemblies are shown extended from mast 20. They provide a rectangular framework for supporting a canopy that provides shelter from the sun's rays, or from rain. Each frame assembly has an extended mode wherein it forms a U-shape, inverted with respect to spar assembly 30. The construction and operation of each frame assembly is typified by frame 50*a*. The legs of the U-shape are respectively formed by members 51 and 53 joined by bifold hinge 52, and by members 57 and 59 joined by bifold hinge 58. The bottom of the U-shape is end member 55 joined to inner leg member 53 by hinge 54 and joined to outer leg member 57 by hinge 56. Each frame assembly is hingedly attached to spar assembly 30 by means of hinge unit 32 at the inner end of spar assembly 30 near mast 20, and by means of hinge unit 35 at the outer end of spar assembly 30. Hinge pin 33 through the end of member 51 pivotally attaches it in inner channel-shaped hinge unit 32. Member 51 is restricted to pivotally move in a single frame-plane with its angular movement restricted between the extended mode perpendicular to spar member 31 (as shown), and a folded mode proximate and parallel with spar member 31. Hinge pin 36 through the end of member 59 pivotally attaches it in outer channel-shaped hinge unit 35. Member 59 is restricted to pivotally move in a single frame-plane, with angular movement restricted between the extended mode position perpendicular to spar member 31 (as shown), and a folded mode position proximate and parallel with spar member 31. Hinges 52, 54, 56, and 58 restrict pivotal movement of the frame assembly members to a single common plane to provide planar stiffness to frame 50*a*. Bifold hinges 52 and 58 include a locking device (detailed in FIG. 5) which is engaged when the frame is in the extended mode to provide longitudinal stiffness to the legs of the U-shape. The frame-plane of is generally perpendicular to the axis of mast 20, however, this includes certain canopy designs where the frame-plane to mast axis angle may be less than 90° such that frames 50*a* and 50*b* are slightly sloped downward from spar 30 when mast 20 is held vertical.

Spar 30 is pivotally attached to mast 20 by pivotal joint 24. The pivotal plane of spar 30 about pivotal joint 24 is restricted to the plane which includes the axis of mast 20. In the embodiment shown spar 30 can pivot through an angle of 180° about pivotal joint 24 starting with a collapsed position where spar 30 is proximate and in parallel with mast 20. When spar 30 is in a perpendicular position with respect to mast 20, brace 40 is connected between spar 30 and mast 20 to support spar 30. Brace 40 has two ends. One end 41 is attached to spar 30 at a fulcrum point distanced from pivotal joint 24 and the other end 42 is attached to mast 20 at a support point distanced from pivotal joint 24, forming a triangulated supporting structure for holding spar 30 in the perpendicular position. Brace 40 is a support member that may be totally detached from canopy support 100 when spar 30 is in the collapsed position, or it may remain pivotally attached at end 41, or at end 42 so that it folds proximate and parallel with mast 20 when spar 30 is in the collapsed position. When mast 20 is vertical, end 41 of brace 40 provides a supporting fulcrum at end 41 for spar 30 supporting it as cantilevered beam held horizontally out from mast 20.

Mast 20 is a telescopic assembly having an upper tubular portion 22 and a lower tubular portion 21. Tubular portions 21 and 22 are approximately of equal in length. The distance from the bottom of mast 20 to pivotal joint 24 is adjusted by lengthening or shortening this telescopic assembly. Upper portion 22 slidingly engages in lower portion 21 and is coextensive with lower portion 21 for a distance determined by cotter pin 23. Cotter pin 23 is perpendicular with the axis of mast 20 and passes through diametrically aligned through-holes in both lower portion 21 and upper portion 22 to fasten them together. This is a well known method for interconnecting members of a tubular telescopic assembly. Upper portion 22 has a plurality of pairs of diametrically aligned through-holes spaced along its length (hole 25 is typical). The distance from the bottom of mast 20 to pivotal joint 24 can be adjusted in increments determined by the longitudinal distance between each pair of through-holes in upper portion 22. The distance from the bottom of mast 20 to pivotal joint 24 depends on the longitudinal position of the pair of through-holes in upper tubular portion 22 engaged by cotter pin 23. This figure shows just one exposed through-hole 25. Note: FIG. 2 shows mast 20 further extended and having two exposed through-holes (not identified).

Mast 20 and foot 60 are demountable one from the other. Foot 60 is used to firmly attach canopy support 100 to a solid object such as a chair, a table, a vehicle, or a boat. Foot connector 62 holds mast 20 rigidly to foot 60 by accepting the bottom end of mast lower portion 21 slidingly inside its tubular shape. The angular relationship of cylindrical foot member 61 with respect to spar 30 about the axis of mast 20 is maintained by fixing the radial position of mast lower portion 21 to foot connector 62 by means of one or more set screws. Elongated foot member 61 has a longitudinal axis perpendicular to the axis of mast 20. Clamps 63 and 64 are attached at either end of foot member 61 and they are used to fasten foot 60 to a solid object such that the weight and torsion stresses required to hold canopy support 100 upright are widely distributed to the solid object. Screws 63*a* and 64*a* are used to tighten clamps 63 and 64 respectively to a part of the solid object such as a table edge, the side of a boat, or the rail of a deck.

FIG. 2 shows canopy support 100 mounted on foot 60. Canopy support 100 is shown with frame assemblies 50*a* and 50*b* in the folded mode. Spar 30 is in the collapsed position. Pivotal joint 24 allows all members of the folded frame assemblies and spar 30 to form a bundled, compact, and portable assemblage of canopy support members. In this condition canopy support 100 is easily removed from foot 60. Foot 60 can be left attached to the solid object to which it is clamped.

FIG. 3 shows canopy support 100 attached to foot 60. Canopy support 100 is shown with mast 20 folded proximate and parallel with foot 60. Mast 20 is attached to foot 60 by means of a locking hinge (detailed in FIG. 4).

FIG. 4 is a detailed view of the hinge shown connecting mast 20 to foot 60 in FIG. 3. A section of foot member 61 is shown partially exploded. A section of the bottom end of mast lower portion 21 is substantially parallel with foot member 61. Hinge member 65 is rigidly fixed coaxially within foot connector 62. An elongated square-section hinge member 67 is pivotally attached by hinge pin 66 in a forked channel at the uppermost end of first hinge member 65. Second hinge member 67 pivots about hinge pin 66 with an angular movement range in excess of 180° restricted to a single pivotal plane. The single pivotal plane allows the longitudinal axis of second hinge member 67 to lie parallel with the axis of foot member 61 in the position shown. Sliding member 68 is slidingly engaged on hinge member 67. The double ended arrow indicates the motion direction.

Movement distance is limited between hinge member 65 and spring-pin 69. Rotation is limited by the square shape of the passage through sliding member 68. Sliding member 68 has an outer diameter which tightly fits into the bottom end of lower mast portion 21 (shown exploded) and is firmly attached by one or more set screws, typified by screw 21*a*. This hinged connection enables mast 20 to be attached perpendicular to foot 60 when canopy support 100 is in use and to be folded parallel with foot 60 when it is not in use. For example, if foot 60 is clamped to the deck of a boat, canopy support 100 can be used to shelter passengers of the boat while the boat is moving slowly, or is stationary. When the boat is moving at speed across the water, or passing under a low bridge, the folded canopy support can be laid down on the deck of the boat.

FIG. 5 is a detailed section of bifold hinge 52 of the inner leg of U-shaped frame assembly 50*a* (shown partly exploded). This is typical of other bifold hinges which may be part of this embodiment of the canopy support. Bifold hinge 52 is made from two molded parts 52*a* and 52*b*, typically from aluminum. Parts 52*a* and 52*b* are each formed with a short annular portion at one end and an elongated cylindrical portion normal to the annular portion at the other. The annular portion of part 52*b* is stacked vertically over the annular portion of 52*a*. A tubular rivet passing through the center holes of the stacked annular portions is formed to hold parts 52*a* and 52*b* together so that part 52*a* can rotate about the rivet with respect to part 52*b*. The cylindrical portion of part 52*a* is sized to tightly fit into tubular frame member 53 (shown exploded). Spring pin 53*a* is normally forced through diametrically aligned holes in frame member 53 passing via a hole through the diameter of the cylindrical portion of part 52*a* thus fastening bifold hinge 52 to frame member 53. The cylindrical portion of part 52*b* is sized to tightly fit into tubular frame member 51 (shown exploded). Spring pin 51*a* is forced through diametrically aligned holes in frame member 51 passing via a hole through the diameter of the cylindrical portion of part 52*b* thus fastening bifold hinge 52 to frame member 51. Weighted hook 52*c* is used to latch parts 52*a* and 52*b* together so that frame members 51 and 53 are held stiffly, axially, aligned during the extended mode of frame assembly 50*a*. The shaft of hook 52*c* passes from a weight portion up through the axial center of the tubular rivet and hooks downwardly with the hook-end passing through vertically aligned latch holes in the stacked annulus portions of parts 52*a* and 52*b*. Latch holes in the annulus portions through which the hook passes are aligned only when members 51 and 53 are axially aligned. To release bifold hinge 52 from the latched condition so that it can rotationally operate to fold the frame assembly, weighted hook 52*c* must be lifted until its hook-end 52*d* exits the latch hole in the annulus portion of part 52*a*. There are many other ways to make the latching bifold hinge, such as providing a spring loaded hook instead of a weighted hook. These alternatives will be apparent to a person skilled in the art of latching hinges.

FIG. 6 shows spar outer hinge unit 35 and sections of frame assemblies 50*a* and 50*b*. Bifold hinge 56 and sections of outer leg member 55, and members 57 and 59 are shown proximate and parallel with spar member 31 in the folded mode. A section of member 59*b* of frame assembly 50*b* is shown perpendicular to spar member 31 in the extended mode. Socket 38 is attached to hinge unit 35. Socket 38 can accept the axial pivotal end of a cylindrical roller 71*b* (see FIG. 7).

FIG. 7 shows the outer hinge portion of spar 30 when frame assemblies 50*a* and 50*b* support a canopy-segment of a two segment canopy. Canopy-segment 70*a* is supported between cylindrical roller 71*a* and end member 55 of frame assembly 50*a*. Canopy-segment 70*a* is fastened at one end to the outer cylindrical periphery of roller 71*a* and most of the canopy-segment is wound around it. Canopy segment 70*b* is shown attached to and supported by roller 71*b* substantially in the same plane as frame assembly 50*b* (represented by a single frame member). The portion shown of canopy-section 70*b* indicates that only a small portion of it remains wound around roller 71*b* when it is extended by frame 50*b* in the extended mode. Rollers 71*a* and 71*b* are depicted having no retractive mechanism in this figure, however, rollers 71*a* and 71*b* it can be assumed to rotate about an axial pivot typified by socket 38 as shown in FIG. 6. Any retracting mechanism can be used. The mechanism must provide means for rotating roller 71*a* in a direction which winds canopy-segment 70*a* onto the roller's circumferential periphery, and means for rotating roller 71*b* so that it winds canopy-segment 70*b* onto the roller's circumferential periphery. The type of retracting mechanism (not shown) may include a coaxial torque spring as detailed in FIG. 11, similar to the well known mechanism used for retracting window-shades, or it may be a simple, manually operated, knob, or handle.

FIG. 8 is a top elevation of canopy support 100 showing spar 30 extending from mast 20. Frame assembly 50*a* is shown in the folded mode attached to spar 30. Frame assembly 50*b* is shown in the extended mode forming a U-shape. Canopy-segment 70*b* is shown extended and substantially filling the area within frame assembly 50*b*. Canopy-segment 70*a* is shown above frame assembly 50*a*. Note: Although canopy-segment 70*b* is shown attached along the length of the frame assembly's end member, it may not be connected to the end member until after the frame assembly has been extended. Also it need only to be attached at one or two points to allow it to flap and spill wind.

FIG. 9 is a side elevation of the canopy support shown in FIG. 1 through the section indicated by section indicator 9. Brace 40 can be seen attached by hooked end 42 to mast 20 which is the support point and pivotally at end 41 to spar 30 which is the fulcrum point. To engage hooked end 42, spar 30 is raised high enough about pivotal joint 24 to enable hooked end 42 to engage with a socket integral with mast 20. When spar 30 is lowered hooked end 42 of brace 40 enters the socket. Foot 60 is shown with the clamps fixed to clamp the vertical edge of a solid object such as the side of a boat, a deck rail, or a chair back.

FIG. 9*a* is a detailed section view through spar 30 where end 41 is pivotally attached to spar 30 at the fulcrum point by pivot pin 41*a*.

FIG. 9*a* is a detailed section view through mast 20 where hooked brace end 42 is engaged into an integral socket in mast 20 at the support point. 42*a* is a hole wherein a cotter pin may be engaged to prevent hooked end 42 from becoming disengaged.

FIG. 10 is a side elevation of foot 60 showing clamp 64 positioned to grip a horizontal portion of a solid body. Clamp 64 may be fixed to foot member 61 at any angle with respect to the axis of mast 20 about the axis of foot member 61. Clamping device 64*b* is tightened by means of a screw to fix the rotational position of clamp 64. Alternately, the clamp may be left to rotate when a supporting strut is included to position the canopy support (see FIGS. 14 and 15).

FIG. 11 shows inner and outer top sections of a second preferred embodiment of the invention. The section is through section position 11 indicated in FIG. 12. All elements of this embodiment which have similar functions to elements shown in the FIG. 1 embodiment are identified by the same number plus 100. Example: Mast 20 of the first embodiment in FIG. 1 is identified as mast 120 of the second embodiment in FIG. 11. Spar 30 of the first embodiment is identified as spar 130 of the second embodiment in FIG. 11.

Frame assembly 150*a* includes end member 155*a*, outer leg member 159*a*, and inner leg element 151*a*. Members 155*a*, 159*a*, and 151*a* are in the folded mode and are held within channel shaped inner hinge unit 133 at the end of spar 130 adjacent mast 120, and are held by outer hinge unit 135. Connection pins 154*a* and 156*a* are shown directed away from spar 130. Member 159*a* pivots about pivot pin 136. Member 151*a* pivots about pivot pin 132. Canopy-segment 170*a* is shown wound on cylindrical roller 171*a*. Roller 171*a* rotates about shaft 172*a* which is fixedly held by inner hinge unit 133 at one end and by outer hinge unit 135 at its other end. Torsion spring 173*a* is fastened to shaft 172*a* at the end proximate hinge unit 133 and is fastened to roller 171*a* at the end proximate hinge unit 135. When canopy-segment 170*a* is wound as shown, torsion spring 173*a* is at its most relaxed condition. This retracting mechanism is well known to be used for retracting window shades.

Hinge units 133 and 135 of spar 130 are fastened at opposite ends of tubular member 131. Pivotal bracket 133*a* is integral with inner hinge unit 133. Canopy-segment 170*b* is shown partially wound on roller 171*b* which rotates about shaft 172*b*. Torsion spring 173*b* is tightly wound around shaft 172*b*, attached at one end to shaft 172*b* and at its other end to roller 171*b*. Canopy-segment 170*b* is extended and in tension. Frame member 159*b* pivots about pin 137, is perpendicular to spar member 131, and is therefore in the extended mode. Frame member 151*b* pivots about pin 134, is perpendicular to spar member 131, and is therefore in the extended mode. Pad 135*b* is typical of one of four resilient pads which tightly hold the ends of frame members in the channel-shaped hinge units of spar 130.

FIG. 12 shows the relationship of elements of the second preferred embodiment of the invention. Most of the elongated members have been truncated and a partially exploded portion of the figure shows how mast 120 pivotally joins spar 130, and how brace 140 joins and supports spar 130 to mast 120. Cut-outs in canopy-segments 170*a* and 170*b* indicated by jagged lines, allow otherwise hidden elements to be viewed. For detailed identification of frame assembly members view this figure in conjunction with FIG. 11.

Spar 130 includes inner hinge unit 133 adjacent mast 120 and outer hinge unit 135. Pivotal bracket 133*a* is integral with inner hinge unit 133. A pivotal joint is formed between spar 130 and mast 120 when pin 126 is inserted through bracket hole 133*b*, via any one of the diametric through-holes (typically identified as 125), and through bracket hole 133*c*. Mast 120 has a plurality of diametric through-holes spaced along its length. The distance from the bottom of mast 120 to the pivotal joint can be adjusted in increments based on the longitudinal distance between the diametric through-holes in mast 120. The distance from the bottom of mast 120 to the pivotal joint depends on the longitudinal position of the through-holes engaged by cotter pin 126. Spar 130 is supported in a perpendicular position with respect to mast 120 by a channel-sectioned, elongated brace 140. Brace end 142 is fastened to mast 120 at the support point by a cotter pin which passes through brace 140 and one of the through-holes in mast 120. Brace end 141 is fastened to spar 130 at the fulcrum point, distanced from pivotal bracket 133*a* by a cotter pin which passes through brace 140 at end 141 and via a diametric through-hole in spar 130 at a distance from pivotal bracket 133*a*.

The method for fastening brace 140 and spar 130 to mast 120 and for adjusting the height of the spar is different in this embodiment of this invention from the embodiment shown in FIG. 1. Brace 140 is shown supporting spar 130 from below stressed compressively. It will be obvious to one skilled in the art of structures that brace 140 may support spar 130 from above under tensile stress between mast 120 and spar 130 without altering the basic teachings of this invention (see FIG. 17). When one of the cotter pins is removed from holding brace 140 in place spar 130 is free to move to a collapsed position proximate and parallel with mast 120. the cotter pin which was not removed holds brace 140 connected to the canopy support, and can be folded proximate and parallel with mast 120.

Canopy-segment 170*a* is shown in a retracted mode covering folded frame assembly 150*a* and connected to frame end member 155*a*. Canopy-segment 170*b* is shown extended and in tension between roller 171*b* and end frame member 155*b*. End frame member 155*b* is shown extended beyond the normal position when the frame is in the extended mode providing an exploded view of how connection pins 154*b* and 156*b* projecting from frame member 155*b* are to be inserted into the ends of frame members 151*b* and 159*b* respectively to form a U-shape. In this preferred embodiment rubber plugs are captured in the ends of tubular members 151*b* and 159*b* so that axial holes in the rubber plugs accept pins 154*b* and 156*b* respectively to form the U-shaped frame in the extended mode. Opposed resilient pads 135*a* and 135*b* made from a material such as rubber are typical of the other opposed pads in hinge units 135 and 132 used to provide frictional control over the ends of the frame members when they are in the folded mode or in the extended mode.

Foot 160 made from two opposed back to back right angle brackets holds mast 120 perpendicular to horizontal flange portion 161. Screw 164*a* is typical of hold-down fasteners attaching foot 160 to horizontal solid object 90. Cotter pins 166*a* and 166*b* pass through diametric through-holes in mast 120 from one side of foot 160 to the other side to provide a locking hinge. When pin 166*b* is removed, mast 120 can pivot about cotter pin 166*a* and fold down parallel with horizontal flange portion 161 if spar 130 is in the collapsed position.

FIG. 13 is a top elevation of the embodiment shown in FIG. 12. Spar 130 is shown in the perpendicular position with respect to mast 120. End member 155*b* of frame assembly 150*b* is shown in the extended mode. Canopy-segment 170*b* is shown supported by extended frame member 155*b*. Canopy-segment 170*a* is shown retracted and covering folded frame 150*a* (hidden).

FIG. 14 is a perspective view of canopy support 100 fastened to solid object 90*a* in the form of a boat. A canopy is shown covering the frames of canopy support 100. The canopy has two canopy-segments 70*c* and 70*d*. Mast 20 and brace 40 are shown. Foot 60 is clamped to the side of the boat and provides vertical stiffness to mast 20 with respect to the longitudinal dimension of boat 90*a*. Strut 80 connected between spar 30 and the opposite side of boat 90*a* provides lateral stiffness to spar 30 with respect to the width dimension of boat 90*a*.

FIG. 15 is a side elevation of canopy support 100 attached to boat 90*a*. Foot 60 is clamped to the side of the boat. Mast 20 is pivotally fastened to foot 60 by means of hinge 60*a*. Spar 30 is pivotally connected to mast 20. Brace 40 provides compressive support between spar 30 and mast 20 so that spar 30 is held as a cantilevered structure across boat 90*a*. Strut 80 is pivotally fastened to spar 30 at one end 81 and pivotally attached to the other side of boat 90*a* at a position opposite mast 20. Strut 80 is adjusted to the appropriate length to support spar 30 at the desired angle with respect to boat 90*a* and is fixed at that length.

FIG. 16 is a perspective view of canopy support 100*a* supporting a single segment canopy 70*c*. Mast 20 is fastened at its bottom end to a solid object 90*b* on the form of a bench. Mast 20 and brace 40 support spar 30 in a position perpendicular to mast 20. Spar 30 supports a single frame assembly 50*a* held in a U-shape generally in a plane perpendicular to mast 20 over bench 90*b*.

FIG. 17 is a perspective view of a canopy support 100*b* wherein mast 20*a* is supported above a solid object 90*c* in the form of a base footing by means of foot 60*a*. Mast 20*a* and tensile stress braces 40*a* and 40*b* respectively support spars 30*a* and 30*b* in a position substantially perpendicular to mast 20. Support braces 40*a* and 40*b* are simple tensed cable braces holding related spars 30*a* and 30*b* respectively in the perpendicular position. Spar 30*a* holds frame assemblies 150*a* and 150*b* in a plane generally perpendicular with mast 20*a*. Spar 30*b* holds frame assemblies 150*c* and 150*d* in opposing relationship and in a plane generally perpendicular with mast 20*a*. Each frame is in the form of an inverted U-shape as disclosed in detail in FIGS. 11 and 12 with respect to the spar to which it is attached. While the planar angle of each frame assembly with respect to mast 20*a* is slightly less than 90° to provide a means for shedding rain, it can generally be considered as perpendicular for the purposes of describing the structure. Canopy-segments 170*a*, 170*b*, 170*c*, and 170*d* are self retracting as shown in FIG. 12.

This disclosure shows and discusses a few of the possible ways to make a canopy support, providing a versatile rectangular shelter which is easily folded into a relatively small bundle of connected parallel elements. It will be obvious that there are many more species of canopy design which can be made using the combination and methods shown here.

What I claim is:

1. A foldable support supporting for a canopy comprising:

a) an elongated mast, having a longitudinal mast axis, and a bottom end;

b) at least one elongated spar, each said spar having a longitudinal spar axis, an inner end, an outer end, and a fulcrum point distanced from said inner end, each said spar independently having a collapsed position and a perpendicular position such that each said spar in said collapsed position is disposed proximate and parallel with said mast, and in said perpendicular position is supported substantially perpendicular to said mast axis;

c) each said spar being joined at said inner end, to said mast at a position distanced from said bottom end of said mast by a related pivotal joint, one said related pivotal joint for each spar, each said spar pivoting about said related pivotal joint substantially restricted to a pivotal plane that includes all said spar axis and all said mast axis;

d) each said spar having a related brace supporting said spar when it is in said perpendicular position, one said related brace for one said spar, each said related brace having two ends being attached at one end to said spar at said fulcrum point and being attached at its other end to said mast at a support point distanced from said related pivotal joint;

e) at least one frame assembly related to each said spar, each said related frame assembly being attached to said respective spar at a position proximate said inner end and at a position proximate said outer end, each said related frame comprising a plurality of elongated members, including an end member, and having two structural modes, a folded mode wherein said members are disposed proximate and parallel with said respective spar, and an extended mode wherein said members form an inverted U-shape wherein said end member is parallel and distanced from said respective spar;

f) each said spar in said perpendicular position and said related frame assembly in said extended mode defining a substantially rectangular supporting structure in a plane generally perpendicular to said mast axis;

g) means for attaching said bottom end of said mast to a solid object.

2. The foldable support of claim 1, wherein said means for attaching said bottom end of said mast to a solid object comprises:

a) an elongated, demountable foot having a longitudinal foot axis perpendicular to said mast axis;

b) said foot having at least one clamping device for clamping said foot to said solid object;

c) said mast axis being angularly adjustable with respect to said solid object, rotationally about said foot axis.

3. The foldable support of claim 1, wherein said means for attaching said bottom end of said mast to a solid object includes:

a) a locking hinge providing two operating modes, a vertical mode wherein said mast is rigidly attached to said solid object in a substantially vertical position, and a horizontal mode wherein said mast is laid down with said mast axis being substantially horizontal.

4. The foldable support of claim 1, wherein said distance between said bottom of said mast and any one of said pivotal joints is adjustable.

5. The foldable support of claim 1, including an elongated stabilizer strut having two ends and an adjustable length, one end of said stabilizer strut being pivotally attached to said outer end of one said spar when said respective spar is in said perpendicular position, the other end of said strut being attached to said solid object at a distance from said mast.

6. The foldable support of claim 1, wherein it comprises one spar supporting two related frame assemblies in opposing attachment to said spar.

7. The foldable support of claim 1, wherein it comprises two spars in opposing attachment to said mast.

8. The foldable support of claim 7, wherein each said spar supports two said related frame assemblies.

9. The foldable support of claim 1, comprising:

a) one spar having one related frame assembly;

b) said related frame assembly including an elongated cylindrical roller, said roller having a longitudinal roller axis and a circumferential outer periphery, said roller being proximate, coextensive, and parallel with said spar, and being attached to said spar such that said roller can rotate about said roller axis;

c) said canopy being substantially rectangular and having a first end, said first end being attached said outer periphery of said roller;

d) said canopy being wrapped spirally around said roller when said related frame assembly is in said folded mode;

e) said canopy being supported between said roller and said end member of said frame assembly when said related frame assembly is in said extended mode.

10. The foldable support of claim 9, wherein said roller includes a spring-loaded mechanism for rotating said roller about said roller axis to automatically wrap said canopy spirally around said roller when said frame assembly is in said folded mode.

11. The foldable support of claim 1, further comprising:

a) each said related frame assembly having a related elongated cylindrical roller, one said related roller for one related frame assembly, each said related roller having a longitudinal roller axis and a circumferential outer periphery, said related roller being proximate, coextensive, and parallel with said respective spar, and being attached to said respective spar such that said related roller can rotate about said roller axis;

b) said canopy comprising a plurality of canopy segments, each said canopy segment being related to each said related roller, one said related canopy segment for one said related roller, each said related canopy segment being substantially rectangular and having a first end, said first end being attached to said outer periphery of said related roller;

c) said related canopy segment being wrapped spirally around said related roller when said related frame assembly is in said folded mode;

d) said related canopy segment being supported between said related roller and said end member of said related frame assembly when said related frame assembly is in said extended mode.

12. The foldable support of claim 11, wherein each said related roller includes a spring-loaded mechanism for rotating said related roller about said roller axis to automatically wrap said related canopy segment spirally around said related roller when said related frame assembly is in said folded mode.

13. The foldable support of claim 11, wherein it comprises one spar supporting two frame assemblies in opposing attachment to said spar.

14. The foldable support of claim 11, wherein it comprises two spars in opposing attachment to said mast.

15. The foldable support of claim 11, wherein each said spar supports two said frame assemblies.

* * * * *